United States Patent [19]

Bialy et al.

[11] Patent Number: 5,076,146

[45] Date of Patent: Dec. 31, 1991

[54] METHOD AND APPARATUS FOR PROTECTING A CYLINDER OF AN HYDRAULIC ELEVATOR

[75] Inventors: Louis Bialy, Simsbury, Conn.; Berry M. Grant, Bloomington, Ind.; John T. Pitts, West Hartford; Sib S. Ray, Newington, both of Conn.

[73] Assignee: Otis Elevator Company, N.J.

[21] Appl. No.: 553,821

[22] Filed: Jul. 18, 1990

[51] Int. Cl.[5] ..... F01B 31/00

[52] U.S. Cl. ..... 92/86; 92/169.1; 73/40.5 R; 73/49.2

[58] Field of Search ..... 92/86, 169.1; 73/49.2, 73/40.5 R, 291, 222, 302

[56] References Cited

U.S. PATENT DOCUMENTS

| | | | |
|---|---|---|---|
| 1,846,299 | 2/1932 | Bristol | 92/86 |
| 3,320,969 | 5/1967 | Gordon | 73/49.2 |
| 3,741,075 | 6/1973 | Moseley et al. | 92/86 |
| 3,848,765 | 11/1974 | Durkop | 73/49.2 |
| 3,885,435 | 5/1975 | Cascio | 73/290 R |
| 3,943,717 | 3/1976 | Schexnayder | 92/86 |

FOREIGN PATENT DOCUMENTS

| | | | |
|---|---|---|---|
| 2735804 | 2/1979 | Fed. Rep. of Germany | 73/49.2 |
| 3007658 | 9/1981 | Fed. Rep. of Germany | 73/290 R |
| 0108012 | 8/1979 | Japan | 73/49.2 |
| 54-108012 | 8/1979 | Japan | 73/49.2 |

*Primary Examiner*—Edward K. Look
*Assistant Examiner*—Todd Mattingly
*Attorney, Agent, or Firm*—Lloyd D. Doigan

[57] ABSTRACT

Fluid is detected within a protective encasement of an hydraulic cylinder of an elevator by applying a low pressure to the interior of the encasement and sensing for the presence of fluid as a result of the application of the low pressure. If fluid is detected, a greater pressure is applied within the protective encasement to eliminate the detected fluid. The protective encasement, which may be pressurized, has a pressure input port, an evacuation port, and an evacuation tube which attaches to the fluid evacuation port and extends to a region within the encasement below the bottom of the cylinder.

9 Claims, 1 Drawing Sheet

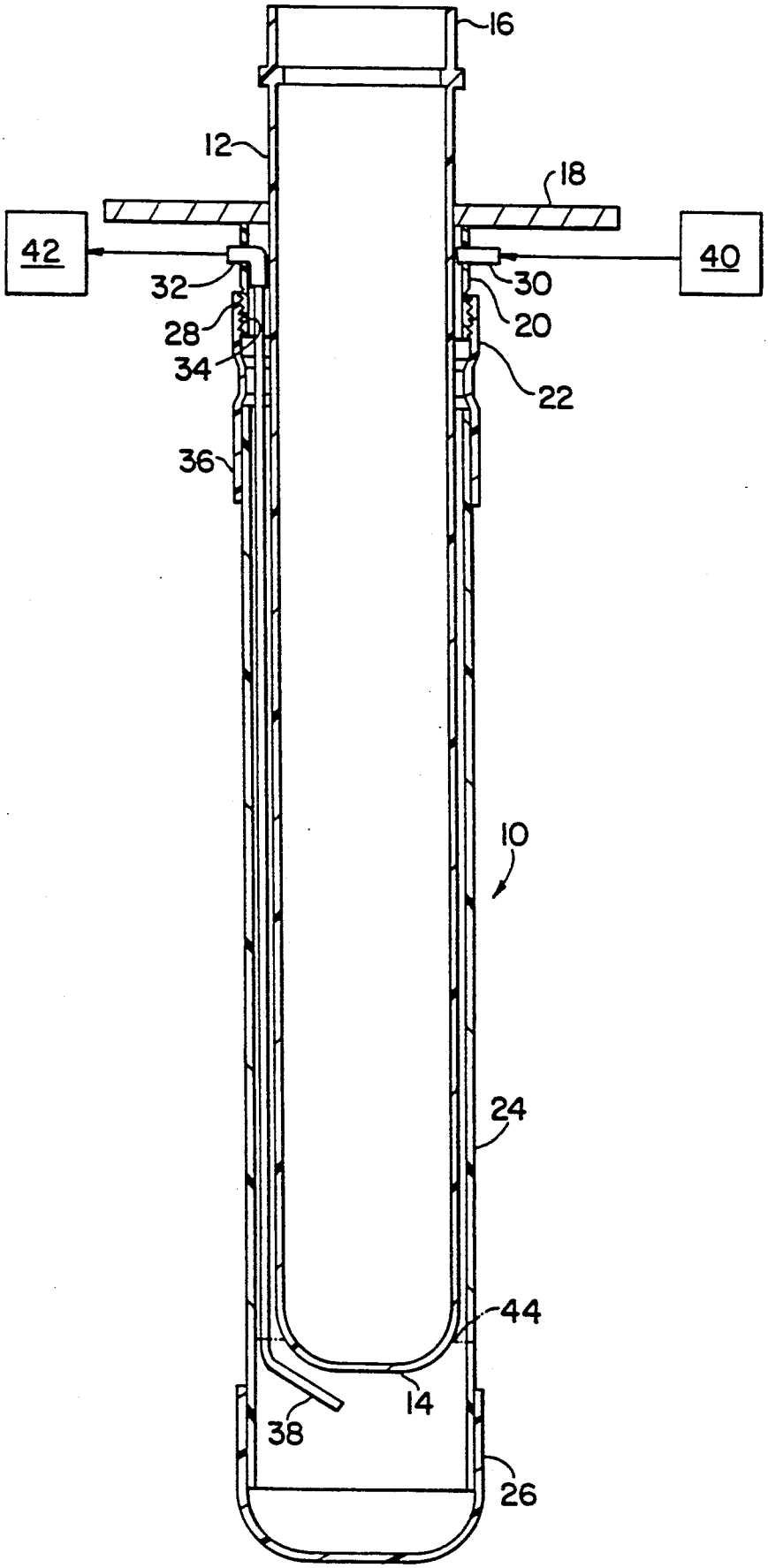
16
12
18
42
40
32
30
28
20
34
22
36
10
24
44
14
38
26

METHOD AND APPARATUS FOR PROTECTING A CYLINDER OF AN HYDRAULIC ELEVATOR

TECHNICAL FIELD

This invention relates to hydraulic elevators and more particularly to a method and apparatus for protecting the cylinder of a hydraulic elevator.

BACKGROUND ART

Hydraulic elevators cars are typically driven upwardly and downwardly by a direct acting, single stage hydraulic piston and cylinder. The cylinder, which is generally constructed of steel, is usually installed underground beneath the elevator car frame and platform.

The underground environment presents several problems. The soil and ground water surrounding the cylinder may subject the cylinder to the corrosive effects of alkalies, sulphur and salt, among other things. Also, the cylinder may present an environmental hazard by leaking hydraulic fluid into aquifers.

Various methods and devices have been used to prevent cylinder corrosion. Cylinders have been covered with tapes and other coatings. Moreover, cathodic protection utilizing a sacrificial anode or impressed current has been utilized. These approaches have achieved various degrees of relatively short-term success. However, a method for long term, i.e., greater than twenty years, corrosion protection is needed.

Some cylinders are enclosed by a PVC encasement as a means of protecting the cylinder from corrosive environments. However, a PVC encasement may leak due to damage during shipping or installation, joint seepage, pit flooding, ground movement after installation, and more.

Because of the possibility that the PVC encasement might leak, detection of any leakage into the PVC encasement may be required. Obviously, if fluid is detected within the PVC encasement, it must be removed to minimize cylinder corrosion and minimize the danger to the environment. Pumps disposed at the top of the cylinder are ineffective in removing liquid from greater depths than some cylinders require, i.e. below thirty feet. Submerging a pump would also be impractical as there is not enough space to fit a pump between the PVC encasement and the cylinder. Moreover, it would be nearly impossible to service a submerged pump. A new method and apparatus to detect and remove fluid disposed between the PVC encasement and cylinder is required.

DISCLOSURE OF THE INVENTION

It is an object of the invention to provide a system for detecting fluid disposed between a protective encasement and a hydraulic cylinder of an elevator.

It is a further object of the invention to remove any detected fluid disposed between a hydraulic cylinder of an elevator and a protective encasement.

According to the invention, fluid, such as a liquid, is detected within a protective encasement of an hydraulic cylinder of an elevator by applying a low pressure gas to the interior of the encasement and sensing for the presence of fluid as a result of the application of the low pressure. If fluid is detected, a greater pressure is applied within the protective encasement to eliminate the detected fluid.

According further to the invention, a protective encasement for a hydraulic cylinder of an elevator has a pressure input port, an evacuation port, and an evacuation tube which attaches to the fluid evacuation port and extends to a region within the encasement below the bottom of the cylinder. A compressed gas source which is capable of applying at least two different pressures and a moisture detector may be utilized.

According to a feature of the invention, the protective encasement is disposed about the hydraulic cylinder so that the volume between the hydraulic cylinder and the encasement may be pressurized.

These and other objects, features and advantages of the present invention will become more apparent in light of the detailed description of a best mode embodiment thereof, as illustrated in the accompanying drawing.

BRIEF DESCRIPTION OF THE DRAWING

The drawing is a schematic view of an embodiment of a protective encasement disposed about an hydraulic elevator cylinder which incorporates an embodiment of the invention.

BEST MODE FOR CARRYING OUT THE INVENTION

Referring to the drawing, an embodiment of an invention for monitoring and evacuating fluid, such as hydraulic fluid, ground water or other liquid, from between a protective encasement 10 and a cylinder 12 of an hydraulic elevator (not shown) is shown. The cylinder and the encasement are typically disposed underground beneath the car frame and platform (not shown) of a hydraulic elevator. The cylinder is constructed typically of steel.

The cylinder 12 has a closed end 14 and an open end 16 through which a piston (not shown) reciprocates to drive the elevator (not shown) upwardly and downwardly. The cylinder is typically suspended, from an upper portion thereof, within an elevator pit (not shown) by a support plate 18.

The encasement 10 is comprised of the support plate 18, an annular sleeve 20, an adapter 22, a tube 24 and an end cap 26. The tube 24, the end cap 26, and the adapter 22 are typically constructed of a material which is relatively impervious to the environment such as polyvinyl chloride (PVC) or the like. The support plate 18 is constructed of steel.

According to the embodiment shown, the annular sleeve 20 extends downwardly from the support plate 18 and about the cylinder 12. The sleeve has a threaded lower exterior surface 28. A nipple 30, which extends through the sleeve, acts as a pressure port as will be discussed infra. Similarly, an L-shaped nipple 32 extends through the sleeve and acts as an evacuation port as will be discussed infra.

The adapter 22 is annular and has a threaded upper interior surface 34. The threaded interior surface 34 of the adapter sealingly mates with the exterior threaded surface 28 of the sleeve 20. The adapter has a lower portion 36 for receiving the tube 24.

The tube 24 is bonded within the lower portion 36 of the adapter 22 by conventional means such as gluing. The tube extends downwardly below the closed end 14 of the cylinder 12. The end cap 26 is attached to the tube by conventional means such as gluing.

The support plate 18, the cylinder 12, the sleeve 20, the adapter 22, the nipples 30, 32, the tube 24 and the end cap 26 are connected and glued, as one of ordinary skill in the art may appreciate, to minimize leakage therein and therefrom and to allow an increase of pressure between the encasement 10 and the cylinder so that fluid between the encasement and the cylinder may be detected and evacuated as will be discussed infra.

A pipe 38, which is relatively impervious to the environment (i.e. PVC), is attached to the L-shaped nipple 32 and extends between the tube 24 and the cylinder 12 below the closed end 14 of the cylinder.

In operation, a compressed gas source 40 (shown schematically) is attached to the pressure port by conventional valving (not shown). A compressed gas, such as air, is supplied to the volume between the cylinder 12 and the encasement 10 by a portable compressor or compressed gas tank (shown schematically at 40). Such compressors or gas tanks, as is well known in the art, have valving (not shown) which can provide different pressures as may be required.

To detect the presence of fluid in the encasement 10, a relatively low pressure (i.e., about 10 PSI) is applied to the nipple 30. The L-shaped nipple 32 is then checked. Air flow from the L-shaped nipple indicates that there is no fluid in the encasement. Fluid flow from the evacuation pipe indicates fluid in the encasement. Similarly, no air flow indicates fluid in the encasement as the relatively low pressure in the encasement is not sufficient to push either the fluid through the pipe 38 and out the L-shaped nipple. A moisture sensor 42, as is known in the art, may be utilized at the L-shaped nipple to detect fluid in the encasement.

If it is determined that fluid is disposed between the cylinder 12 and the encasement 10, the pressure applied to the nipple 30 is increased to a point where the pressure on the fluid is greater than the static pressure at the level of the fluid column (shown by phantom line 44) plus atmospheric pressure plus minor frictional losses (i.e., totalling about 50 PSI, depending on the application). In other words, the fluid is pushed by the increased air pressure through the pipe 38 and out the L-shaped nipple 32.

Although the invention has been shown and described with respect to a best mode embodiment thereof, it should be understood by those skilled in the art that the foregoing and various other changes, omissions and additions and the form and detail thereof may be made therein without departing from the spirit and scope of the invention. The encasement 10, the nipples 30, 32, the pipe 38 and the cylinder 12 may be arranged in any suitable manner by which the encasement may be pressurized to permit the detection and evacuation of fluids disposed between the encasement and the cylinder as detailed above without departing from the spirit and scope of the invention.

We claim:

1. Method for detecting and removing fluid disposed within a volume between an hydraulic cylinder and a protective encasement therefor, said method comprising the steps of:

pressurizing said volume to a first pressure, sensing for the presence of fluid in said volume in response to pressurizing said volume to said first pressure, and pressurizing said volume to a second pressure, greater than said first pressure and sufficient to remove fluid from said volume, upon sensing fluid within said volume.

2. The method of claim 1 wherein said sensing step comprises:

detecting the presence of fluid in gas escaping from said volume, as a result of pressurizing said volume to said first pressure.

3. The method of claim 1 wherein said sensing step comprises:

detecting the absence of gas escaping from said volume, as a result of pressurizing said volume to said first pressure.

4. The method of claim 1 wherein said pressurizing said volume to a second pressure step comprises:

pressurizing said volume to a second pressure greater than the static pressure at a level of said fluid within said volume plus atmospheric pressure plus frictional losses.

5. Apparatus for detecting and removing fluid disposed within a volume between an hydraulic cylinder and a protective encasement therefor, said apparatus comprising:

means for inducing a first pressure into said volume solely for detecting the presence of fluid in said volume and for inducing a second pressure into said volume for removing fluid detected within said volume, and an evacuation means for removing fluid from said volume, said evacuation means including a tube extending below a bottom of said hydraulic cylinder.

6. Apparatus comprising:

an hydraulic cylinder, an encasement enclosing said cylinder such that a volume between said cylinder and said encasement may be pressurized, means for inducing a first pressure into a volume solely for detecting the presence of fluid in said volume and for inducing a second pressure into said volume for removing fluid detected within said volume, and an evacuation means for removing fluid from said volume, said evacuation means including a tube extending below a bottom of said hydraulic cylinder.

7. Apparatus comprising:

a cylinder, an encasement enclosing said cylinder such that a volume between said cylinder and said encasement may be pressurized, means for inducing a first pressure into a volume solely for detecting the presence of fluid in said volume and for inducing a second pressure into said volume for removing fluid detected within said volume, and an evacuation means for removing fluid from said volume, said evacuation means including a tube extending below a bottom portion of said cylinder.

8. Apparatus comprising:

an hydraulic cylinder, an encasement enclosing said cylinder such that a volume between said cylinder and said encasement may be pressurized, means for inducing a first pressure into a volume solely for detecting the presence of fluid in said volume and for inducing a second pressure into said volume for removing fluid detected within said volume, and a means for detecting the presence of fluid in said volume and for removing fluid from said volume, said means including a tube extending below a bottom of said hydraulic cylinder.

9. Apparatus comprising:

a cylinder, an encasement enclosing said cylinder such that a volume between said cylinder and said encasement may be pressurized, means for inducing a first pressure into a volume solely for detecting the presence of fluid in said volume and for inducing a second pressure into said volume for removing fluid detected within said volume, and a means for detecting the presence of fluid in said volume and for removing fluid from said volume, said means including a tube extending below a bottom of said cylinder.

* * * * *